US008584698B2

(12) United States Patent
Brun et al.

(10) Patent No.: US 8,584,698 B2
(45) Date of Patent: Nov. 19, 2013

(54) PROGRAMMABLE DEVICE FOR COMPRESSOR VALVE

(75) Inventors: Klaus Brun, Helotes, TX (US); Merle E. Converse, Helotes, TX (US); Jerome A. Helffrich, Boerne, TX (US)

(73) Assignee: Southern Gas Association Gas Machinery Research Council, Dallas, TX (US)

( * ) Notice: Subject to any disclaimer, the term of this patent is extended or adjusted under 35 U.S.C. 154(b) by 336 days.

(21) Appl. No.: 12/937,836

(22) PCT Filed: Mar. 30, 2009

(86) PCT No.: PCT/US2009/038837

§ 371 (c)(1),
(2), (4) Date: Oct. 14, 2010

(87) PCT Pub. No.: WO2009/129044

PCT Pub. Date: Oct. 22, 2009

(65) Prior Publication Data

US 2011/0023980 A1 Feb. 3, 2011

Related U.S. Application Data

(60) Provisional application No. 61/045,193, filed on Apr. 15, 2008.

(51) Int. Cl.
*F16K 31/02* (2006.01)

(52) U.S. Cl.
USPC ..... 137/487.5; 137/47; 251/129.01

(58) Field of Classification Search
USPC ..... 137/47–51, 487.5; 251/129.05, 129.01
See application file for complete search history.

(56) References Cited

U.S. PATENT DOCUMENTS

| | | | | |
|---|---|---|---|---|
| 3,260,271 | A * | 7/1966 | Katz | 137/47 |
| 3,410,287 | A * | 11/1968 | Heyden et al. | 137/47 |
| 4,089,007 | A * | 5/1978 | Perry et al. | 137/487.5 |
| 4,794,760 | A * | 1/1989 | White | 251/129.05 |
| 5,005,353 | A | 4/1991 | Acton et al. | |
| 5,354,185 | A | 10/1994 | Morinigo et al. | |
| 6,739,293 | B2 * | 5/2004 | Turner et al. | 123/90.12 |
| 6,981,838 | B2 * | 1/2006 | McKee et al. | 415/1 |
| 2007/0154325 | A1 | 7/2007 | Grant et al. | |
| 2007/0272178 | A1 | 11/2007 | Brun et al. | |

* cited by examiner

*Primary Examiner* — Kevin Lee
(74) *Attorney, Agent, or Firm* — Booth Albanesi Schroeder, LLC

(57) ABSTRACT

An electronic, programmable device for controlling the motion of compressor valve elements, wherein the device receives an incoming signal from a velocity sensor located on a compressor valve; filters, amplifies, and processes the incoming signal by a control algorithm; and responds to the incoming signal by creating an output signal that produces an actuator force that is applied directly to a moving valve element and associated methodology.

3 Claims, 5 Drawing Sheets

PROGRAMMABLE DEVICE FOR COMPRESSOR VALVE

CROSS-REFERENCE TO RELATED APPLICATIONS

This application claims priority to U.S. patent application Ser. No. 61/045,193 filed Apr. 15, 2008 which is incorporated by reference herein in its entirety.

STATEMENT REGARDING FEDERALLY SPONSORED RESEARCH OR DEVELOPMENT

None.

THE NAMES OF THE PARTIES TO A JOINT RESEARCH AGREEMENT

None.

REFERENCE TO SEQUENCE LISTING

None.

BACKGROUND OF THE INVENTION

In order to transport gases over great distances, pipeline and oil companies operate and maintain hundreds of thousands of miles of pipelines. Compressed gases are needed to take part in chemical reactions in refineries and petrochemical plants. To provide forces that move and compress the gases, operators install gas compressors at key points in the process chain The gas compressors are typically reciprocating compressors. It costs a lot of money if a gas compressor valve is damaged and/or fails.

SUMMARY OF THE INVENTION

An electronic, programmable device for controlling the motion of compressor valve elements and associated methods are disclosed herein.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
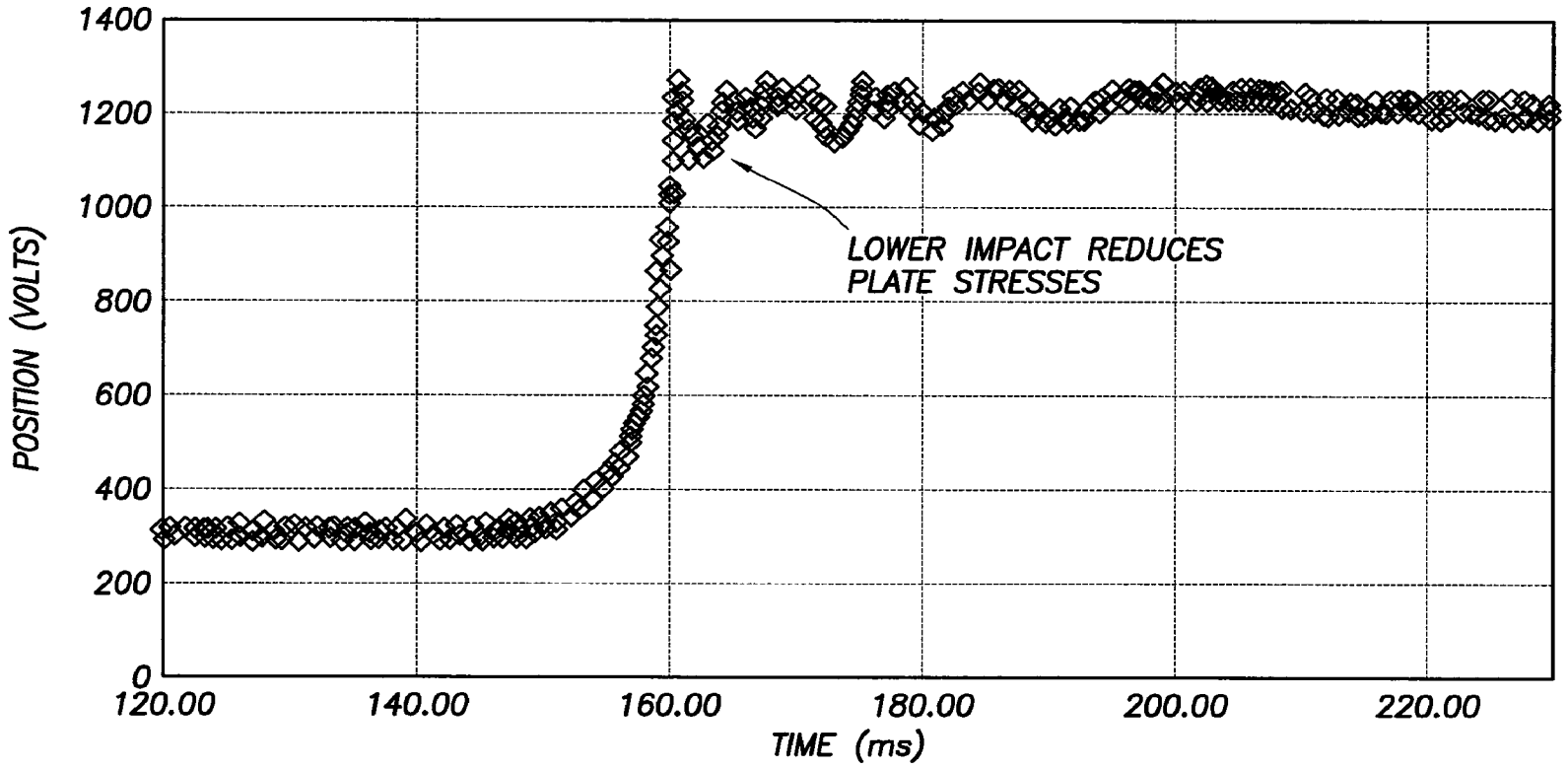
FIG. 1 shows valve plate motion versus time in controlled and uncontrolled plates.

Sealing elements in the inlet and discharge valves of a reciprocating compressor may be moved to the open or closed position by forces imparted by the differential gas pressure to the movable sealing elements. The sealing elements may alternatively open and close with each stroke of the compressor in order to permit gas flow in one direction but block gas flow in the reverse direction. Methods and a device for controlling valve elements though the use of algorithms installed in a programmable control device is provided.

To date, very little has been done to manage the motion of the compressor valve elements. Spring systems, damper plates, and a variety of different geometries can be introduced to slow plate motion or change the timing of certain events, but the forces from the differential gas pressure on each side of the valve often prevent these devices from achieving effective, long term control. Gas forces are the most dominant force affecting valve element motion. Currently valve elements remain predominately uncontrolled and any performance increases are small and incremental at best.

In addition, fixed control devices do not adjust to the dynamic conditions of an operating gas compressor where the environment is dynamic with constant changes in pressure, gas molecular weight, gas velocities, and capacity (mass flow). Typically, these fixed control devices are specifically designed to operate at certain target conditions. When these fixed control devices are used in variable conditions, or conditions outside of their target conditions, these variables alter the motion of the sealing elements in the compressor valve. Whenever any of these variables control valve element motion, the valve may operate in a manner inconsistent with its design, resulting in a reduction of operating life. Specifically, the timing of the commencement or completion of the opening and closing events, duration of the transit between full open and full closed, and the force with which the valve elements strike the rigid structure of the compressor valve during the valves opening and closing may be affected, resulting in more violent valve element motion and unfavorable valve positioning. Violent valve element motion and unfavorable valve positioning can cause the plates in the valves to break or crack and can also result in damage or destruction of the valve springs.

Moreover, compressor valve life is often directly related to the ability of its sealing element to effectuate a tight seal. Failure to seal results in overheating of the valve and often subsequent failure, requiring a shutdown of the compressor for repairs or replacement of parts. Substantial financial costs occur every time process equipment is shut down for repairs. Hence, operators of reciprocating gas compressors want to minimize the number and frequency of these events.

United States publication 2007/0272178A1, at paragraphs [0022]-[0026], incorporated herein by reference, describes the physical requirements of the type of hardware that can be used to control valve element motion. However, the programmable device for making the valve motion fully controllable and adjustable by external means is needed. This electronic, programmable device can sense changing conditions and send new signals to the hardware to restore the desired motion of the valve plates and thus this active control of the valve plate/element motion can keep the valve dynamics within the design envelope of the valve. Therefore, the aforementioned high velocities and severe impacts can be mitigated.

The methods and programmable device provided herein extend compressor valve life by increasing control over valve element motion, the timing of valve element motion, the duration of valve element motion, and the impact forces of valve element motion. This device provides control over the valve element motion, reducing compression losses (i.e. inefficiencies). Valve plates that close late for example allow for gas to reverse flow and return to the compressor cylinder. This reverse flow will occur until the valve element closes and blocks the flow. Late closure is defined as the time that the valve plate is open after the compressor piston reached top dead center and has itself reversed direction to start the intake stroke. Having the ability to ensure that the valve elements are closed eliminates that possibility of reverse flow and the compressor performance overall is improved by the removal of this inefficiency. The programmable device and associated methodology further provides mass flow control that can be used to make the compressor provide the exact amount of gas for the operating conditions. Specifically, the programmable logic can be set up to force the valve elements to stay open, thereby permitting reverse flow, for some predetermined period of time. The amount of gas that flows back into the compressor cylinder represents a decrease in the downstream flow of the compressor by an equal amount. Controlling the duration of the time period that the elements are open after the piston reaches top dead center means that this programmable device can be very effective as a capacity controller allowing the compressor operator to simply change the timing of the valve element events.

The programmable device can manage the hardware components with a current wave form so as to produce the desired valve actuator motion profile. The programmable device may further receive an analog or digital signal from a valve element velocity sensor and/or some other dynamic sensor related to the operation of the reciprocating compressor, and then provide either semi or fully controlled valve element motion as desired by the compressor operator or required by the operating conditions. Hence, the device and methods described herein are particularly suitable for controlling electromagnetically actuated valves, such as those described in United States publication 2007/0272178A1. The device controls valve element motion through a semi-active control mode as well as a full control mode.

The control process consists of a multi-step feedback loop that includes the following steps: 1) band pass filtering and pre-amplification of an incoming signal; 2) validation of the signal to determine if the signal is form the valve element motion or simply electrical background noise; 3) calculation of an output signal to determine the appropriate response to the sensed motion, and 4) high gain output signal amplification. Step 3 may include determining the appropriate time delay, output voltage amplitude, signal duration and voltage function shape While the programmable device can operate in analog or digital modes, step number four (4) is typically an analog function. The shape of the voltage in function step three can be adjusted and optimized to provide the greatest deceleration to the valve element while minimizing the mechanical stresses on the element. Accelerations and other mechanical forces can be analyzed and studied using readily available finite element codes and maximum and minimum thresholds. Furthermore, these forces are sometimes determinative in setting the parameter of the control function in the programmable device. In this way, the programmable device cannot act in manner that would be as destructive to the valve elements when the operating conditions change. The simplest voltage function would have a saw tooth shape but other functions may be programmed depending on the desired plate/element motion. To do this, more sophisticated, higher order, non-linear polynomials could be derived and programmed into the device (controller) logic.

It is this variable functionality that controls the time delays and durations of events that allow external control of the valve efficiency and overall compressor output (capacity). The voltage function is output to the hardware that is physically attached to the valve elements and determines the magnitude, duration and timing of the forces applied to the valve plates. Semi-active and fully active modes operate in the same manner.

The device can receive, calculate and respond at a frequency in the order of 200 KHz. Valve movements occur in the 1000 Hz range and having a device significantly faster than the movements being controlled allows sampling of the input signals to occur before a response is sent out to the hardware devices. Approximately 100 samples are taken of the incoming signals from each opening and closing event. Processing speed and signal sampling are critical to performing step two in the control process.

Valve plate velocities have been slowed to zero just before impact with the valve seat or valves guard (opening and closing) with direct observation with position and velocity sensors in the lab. Typically uncontrolled plate velocities are between 0.5 and 2.5 meters per second and controlled valve plate velocities can be controlled to nearly any value as long as the applied deceleration forces do not result in mechanical stresses that exceed the material of the valve plate.

FIG. 1 shows valve plate position vs. time. The blue line is uncontrolled plate motion and it is shown that the plate closes rather abruptly and there are subsequent plate bounces after the initial impact. The red dots show valve plate motion in which the programmable device intervened to slow the valve plate before the initial impact. It is shown that the subsequent bounces have been eliminated thereby subjecting the plate to few violent collisions with other structures in the valve.

Figure 2:
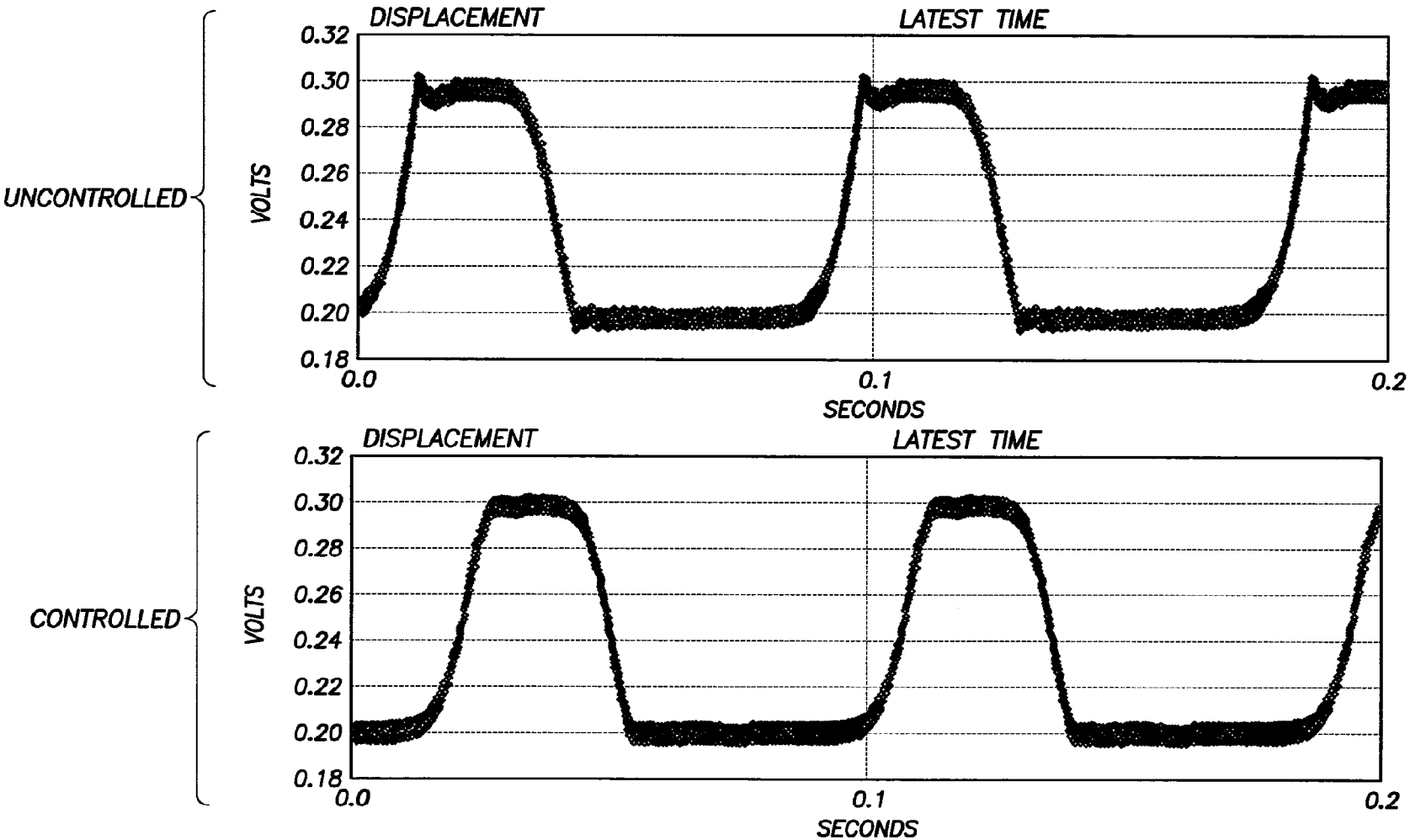
FIG. 2 depicts uncontrolled plate motion versus controlled plate motion.

FIG. 2 shows controlled and uncontrolled plate motion. Again, intervention by the programmable device provides obvious smoothing of the valve motion.

Figure 3:
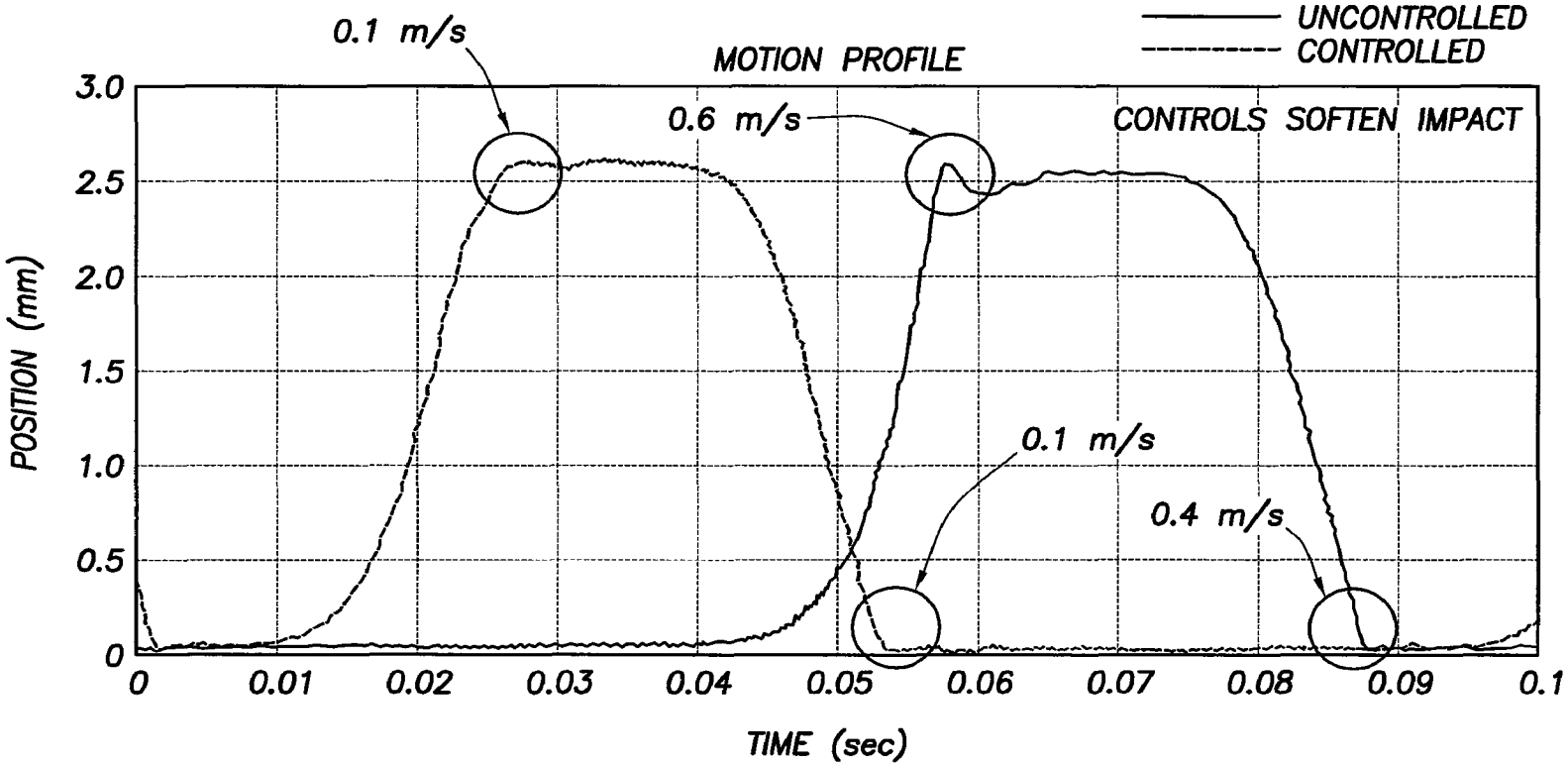
FIG. 3 depicts plate velocities in a valve in controlled and uncontrolled plates.

In FIG. 3, the controlled case (the pink curve) shows the plate velocities reduced to 0.1 m/sec compared to the higher velocities of the uncontrolled curve. High velocities mean higher energy at impact and it these forces that cause valve plates to break in service. The programmable device exercising effective control of the valve plate velocities.

The incoming signal is changed to a current vs. time output signal by the control algorithm, producing an appropriate actuator force that may be applied directly to the moving valve element. As a result, the motion profile (displacement vs. time) of the valve element is independent of any pressure or other gas condition. In the semi-active control mode the changing compressor operating conditions change the velocity profile of the valve element and this element velocity is this parameter that is sensed and acted upon by the programmable device. This operation mode acts on measured valve element velocities and the control algorithm adjusts to changing velocities making this system self-adjustable to varying compressor operating conditions.

Valve element motion may be also controlled through a full control mode. In this mode, additional inputs from devices such as a key phasor reading the compressor crankshaft or flywheel and a motor or an engine drive shaft encoder are available as well as other signals that are synchronized with the operation of the reciprocating gas compressor. Incoming signals may be filtered, amplified, processed as previously described and combined with the other signals for manipulation by the control algorithm. The incoming signal generates a current vs. time output signal that may produce an appropriate actuator force to be applied to the moving valve element. The application of this force may change the motion profile of the valve element independent of any pressure of gas condition. This operation mode acts on measured valve elements and shaft signals as the control algorithm adjusts to the changing signals making this system self-adjustable to varying compressor operating conditions. This operating mode is suitable for compressor capacity (mass flow) control.

Hence, the programmable device can achieve performance objectives by monitoring the valve element. The semi-active and full control modes allow for the establishment of target thresholds through the control of the valve element displacement profile, the valve element velocity profile, the valve element impact velocity profile, and the magnitude of forces sent to the valve element.

The semi-active and full control modes provides for the establishment of target thresholds. Target thresholds, such as minimum and maximum velocities of valve element motion and duration of valve element motion, can be programmed to reduce dynamic impact forces, control the timing of the valve element opening and closing events, change mass flow through the compressor, control the magnitude of the corrective forces sent to the valve elements, and to control valve plate velocities during operation.

Specifically, the semi-active and full control modes further allows for the control of the valve element displacement, element velocity and element impact velocity profiles. The programmable device can provide control of the valve element displacement profile (element position vs. time), element velocity profile and element impact velocity profile.

The semi-active and full control modes may also allow for the control of the magnitude of forces sent to the valve element. The programmable device can provide control of the magnitude of the forces sent to the valve element by limiting the output force of the hardware to some maximum value during operation.

The methods and device described herein provide for external control of the motion of the compressor valve elements and offer the opportunity to improve compressor valve life by reducing the magnitude of the destructive forces generated during the opening and closing events and the timing and duration of the valve motion.

The following description is directed to a design for a suction or discharge valve for a reciprocating gas compressor. More specifically, it is directed to modifying a plate type valve so that it is "semi-active" in the sense that the valve plate starting motion (both opening and closing) is sensed and the motion of the valve plate is fine-tuned, using electromagnetic sensing and control means.

Figure 4:
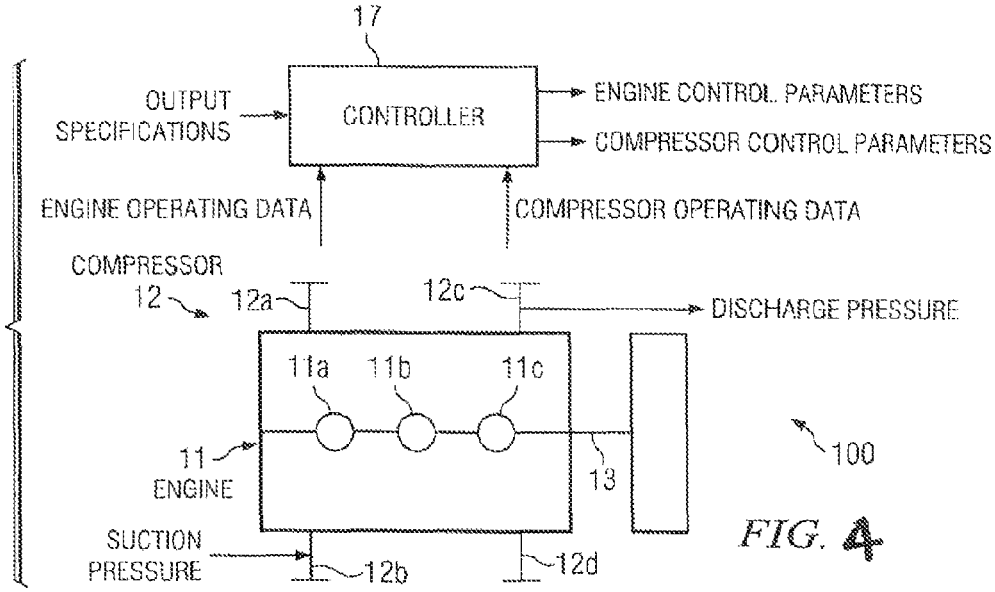
FIG. 4 illustrates an integrated engine/compressor system.

FIG. 4 illustrates a reciprocating gas compressor system 100. Compressor system 100 is an "integrated" compressor system in the sense that its engine 11 and compressor 12 share the same crankshaft 13. The engine 11 is represented by three engine cylinders 11 *a*-11 *c*. Typically, engine 11 is a two-stroke engine. The compressor 12 is represented by four compressor cylinders 12 *a*-12 *d*. In practice, engine 11 and compressor 12 may each have fewer or more cylinders.

FIG. 2 illustrates a reciprocating gas compressor system 200 in which the engine (or motor) 21 and compressor 22 are separate units. This engine/compressor configuration is referred to in the industry as a "separable" compressor system. The respective crankshafts 23 of engine 21 and compressor 22 are mechanically joined at a gearbox 24, which permits the engine 21 to drive the compressor 22.

As indicated in the Background, a typical application of gas compressor systems 100 and 200 is in the gas transmission industry. System 100 is sometimes referred to as a "low speed" system, whereas system 200 is sometimes referred to as a "high speed" system. The trend in the last decade is toward separable (high speed) systems, which have a smaller footprint and permit coupling to either an engine or electric motor.

Both systems 100 and 200 are characterized by having a reciprocating compressor 12 or 22, which has one or more internal combustion cylinders. Both systems have a controller 17 for control of parameters affecting compressor load and capacity.

Figure 5:
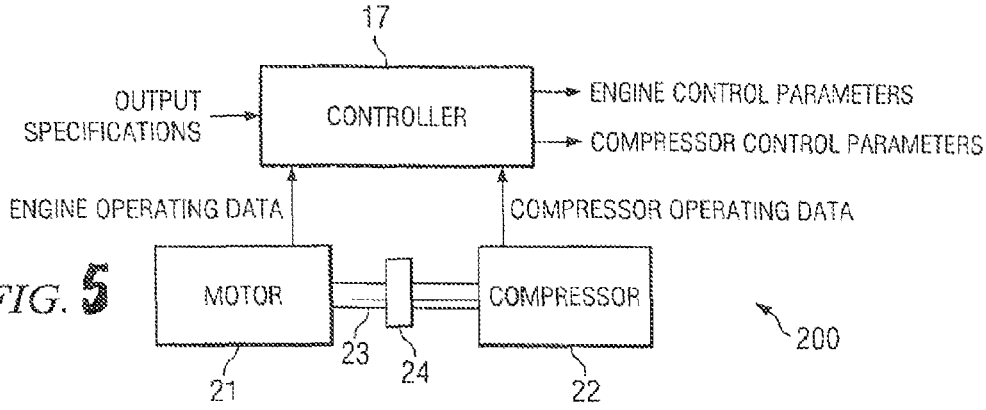
FIG. 5 illustrates a compressor system in which the engine and compressor are separate.

Engine 11 (FIG. 4) or motor 21 (FIG. 5) is used as the compressor driver. That is, the engine's or motor's output is unloaded through the compressor. In the example of this description, motor 21 is an electric motor, but the same concepts could apply to other engines or motors.

As shown in FIG. 4, the compressor systems operate between two gas transmission lines. A first line, at a certain pressure, is referred to as the suction line. A second line, at a higher pressure, is referred to as the discharge line. Typically, the suction pressure and discharge pressure are measured in psi (pounds per square inch). In practical application, gas flow is related to the ratio of the suction and discharge pressures.

The following description is written in terms of the separable system 200 (FIG. 5) driven by motor 21. However, the same concepts are applicable to system 100; as indicated in FIGS. 1 and 2, the same controller 17 may be used with either type of system, modified for the particular drive equipment (engine or motor).

Figure 6:
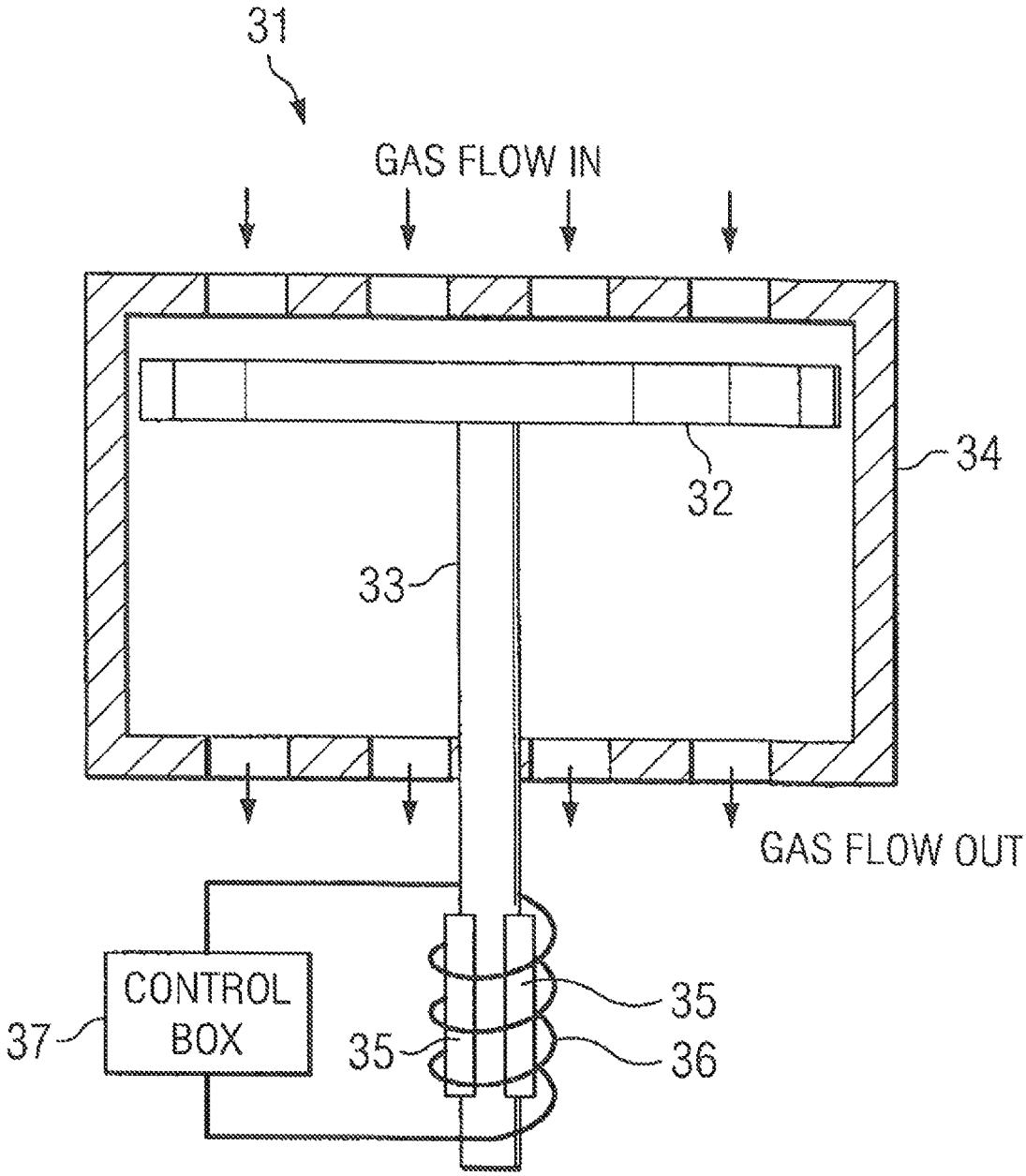
FIG. 6 illustrates a semi-active valve in accordance with the invention, to be used with the compressor cylinders of FIG. 1 or 2.

FIG. 6 is a cross sectional view of a compressor valve 31 in accordance with the invention. Valve 31 is a plate type valve, having a valve plate 32 and valve shaft 33 that move up and down within a valve housing 34.

In other embodiments, valve 31 could be some other type of valve, such as a poppet, check, or ring valve, and the term "plate" is used herein to mean whatever element (i.e., plate, disk, plug, etc.) is used to open or shut off flow. Similarly, the "housing" could be a spring around the shaft or any other rigid structure that guides the motion of the shaft. Some types of valves may have multiple shafts.

The operation of valve 31 is conventional insofar as the valve plate 32 is driven aerodynamically. However, in a conventional valve, the plate is repeatedly driven open and shut against the ends of the valve housing, which causes high pressure forces and a high rate of wear and tear. The velocity at which the plate strikes the end of the cylinder housing is referred to herein as its "impact velocity".

As explained below, this description is directed to using electromagnetic forces to slow the velocity of the plate 32 to reduce impact forces. These electromagnetic forces are not the main driving force for the plate 32, but rather are used to fine-tune its velocity.

To this end, the motion of valve plate 32 is secondarily controlled by using electromagnetic forces applied to valve shaft 33, which is attached to plate 32 at its center. Shaft 33 is a "stub" shaft, rigidly connected to the valve plate 32 to move with the plate 32. The attachment means may be such that shaft 33 is removable. Shaft 33 has embedded permanent magnets 35 along its axis. Outside valve housing 34, shaft 33 is surrounded by electrical coils 36. Movement of plate 32 within housing 34 will result in an induced current in coils 36, which can be directly measured to determine the plate's velocity and location. Also, coil 36 can be activated to affect the movement of shaft 33 and the position of plate 32. For example, if the plate's velocity exceeds a desired impact velocity, the coil 36 can be used to control the position of the plate by inducing an opposing current.

In an alternative embodiment, the location of the coil and magnets relative to shaft 33 may be switched. That is, coil 36 may be placed on shaft 33 and magnets 35 placed outside housing 34. Also, either a single coil can be used for sensing and control (as shown in FIG. 6), or two coils, one for sensing and one for control, may be used. If the valve has more than one shaft, coils (or magnets) may be placed on multiple shafts.

In this manner, the motion of valve plate 32 (both opening and closing) may be sensed by means of magnets 35 and coil 36, which act as an electric inductive motion sensor. If the motion of plate 32 initiates due to a pressure differential across valve 31, the magnets 35 will induce a current into coils 36. This current is sensed by controller 37. If the velocity of the plate exceeds a certain threshold, the same (or an additional) coil/magnet combination can be used to counteract the motion of the plate and slow it down.

In this manner, the valve's motion may be fine-tuned using electromagnetic actuation. Once a small motion is sensed, controller 37 may use a larger counter current to actively control the motion and position of plate 32. The motion sensor and motion control for plate 32 can be integrated into a linear electromagnetic sensing and control device 37.

Control device 37 is typically implemented with software within one or more microprocessors or other controllers. However, implementation with other circuitry is also possible. In general, a reference to a particular process for sensing or controlling the motion of plate 32 represents programming of controller 37 to implement the function. As explained below, controller 37 also has memory so that stored values accessed to determine if the speed of plate 32 exceeds a threshold and to determine how much to slow its motion. Velocity of the plate can be determined by using time and displacement measurements.

The invention described herein permits secondary control of valve plate 32 without the need for internal pressure transducers or shaft encoders. The design uses electromagnets to actively control impact velocities. The plate lift and impact velocity can be finely controlled to improve valve efficiency, capacity, and durability. If the plate control provided by the present invention is not desired or fails, the shaft 33 can be removed and the valve 31 can continue to function as a passive plate valve.

Valve 31 can be used to create a soft landing at both the valve seat on closing and at the valve guard on opening. Valve 31 may be referred to as a "semi-active electromagnetic valve" because it is still activated by gas pressure and only controlled prior to impact. Experimentation has shown that the semi-active valve's plate impact velocities can be reduced by up to 90 percent, increasing plate life by a factor of 15.

What is claimed is:

1. An electronic, programmable device for controlling the motion of compressor valve elements in a reciprocating compressor, wherein the device:

receives an incoming signal from a velocity sensor located on a compressor valve and an additional incoming signal from at least one other sensor selected from the group consisting of: a key phasor, a motor or engine drive shaft encoder, and a sensor synchronized with an operating reciprocating compressor;

filters, amplifies, and processes the incoming signal and additional incoming signal by a control algorithm; and responds to the incoming signal and additional signal by creating an output signal that produces an actuator force that is applied directly to a moving valve element.

2. An electromagnetically actuated valve that is controlled by an electronic, programmable device, wherein the device:

receives an incoming signal from a velocity sensor located on the electromagnetically actuated valve and an additional incoming signal from at least one other sensor selected from the group consisting of: a key phasor, a motor or engine drive shaft encoder, and a sensor synchronized with an operating reciprocating compressor;

filters, amplifies, and processes the incoming signals by a control algorithm; and responds to the incoming signals by creating an output signal that produces an actuator force that is applied directly to a moving valve element of the electromagnetically actuated valve.

3. A valve comprising a valve housing having at least one input port and at least one output port; a plate within the housing the moves up and down within the housing to control passage of fluid through the valve; at least one shaft attached to one side of the plate at least one magnet attached to the shaft; at least one coil surrounding the shaft that is operable to sense motion of the plate and to control the motion of the plate, the valve further comprising:

an electronic, programmable device for receiving a signal from at least one coil, for interpreting the signal as motion of the plate, and for delivering a signal to at least one coil to control motion of the plate wherein the programmable device filters, amplifies, and processes the signal by a control algorithm wherein said programmable device:

receives an incoming signal from a velocity sensor located on the electromagnetically actuated valve;

filters, amplifies, and processes the incoming signal by a control algorithm; and responds to the incoming signal by creating an output signal that produces an actuator force that is applied directly to a moving valve element of the electromagnetically actuated valve.

* * * * *